US009021645B2

(12) United States Patent
Garti

(10) Patent No.: US 9,021,645 B2
(45) Date of Patent: May 5, 2015

(54) POOL CLEANING ROBOT

(71) Applicant: Maytronics Ltd., Kibutz Yizrael (IL)

(72) Inventor: Efraim Garti, Zichron Yaakov (IL)

(73) Assignee: Maytronics Ltd., Kibutz Yizrael (IL)

( * ) Notice: Subject to any disclaimer, the term of this patent is extended or adjusted under 35 U.S.C. 154(b) by 0 days.

(21) Appl. No.: 14/271,491

(22) Filed: May 7, 2014

(65) Prior Publication Data

US 2014/0326652 A1 Nov. 6, 2014

Related U.S. Application Data

(63) Continuation of application No. 13/684,540, filed on Nov. 25, 2012, now Pat. No. 8,800,088, which is a continuation of application No. 12/793,201, filed on Jun. 3, 2010, now Pat. No. 8,424,142.

(60) Provisional application No. 61/184,115, filed on Jun. 4, 2009.

(51) Int. Cl.
*E04H 4/16* (2006.01)

(52) U.S. Cl.
CPC ..... *E04H 4/1654* (2013.01); *Y10S 901/01* (2013.01)

(58) Field of Classification Search
USPC ..... 15/1.7, 319, 339, 340.4, 384, 347
See application file for complete search history.

(56) References Cited

U.S. PATENT DOCUMENTS

| | | | | |
|---|---|---|---|---|
| 3,950,809 | A * | 4/1976 | Schatzmann | 15/1.7 |
| 7,117,554 | B2 * | 10/2006 | Pichon | 15/1.7 |
| 2001/0050093 | A1 * | 12/2001 | Porat | 134/8 |
| 2002/0104790 | A1 * | 8/2002 | Lincke | 210/169 |
| 2006/0174430 | A1 * | 8/2006 | Pareti | 15/1.7 |
| 2007/0028405 | A1 * | 2/2007 | Garti | 15/1.7 |
| 2007/0251032 | A1 * | 11/2007 | Pichon et al. | 15/1.7 |
| 2010/0065482 | A1 * | 3/2010 | Sumonthee | 210/167.1 |

* cited by examiner

*Primary Examiner* — Brian Glessner
*Assistant Examiner* — Brian D Mattei
(74) *Attorney, Agent, or Firm* — Oren Reches

(57) ABSTRACT

A pool cleaning robot for cleaning a surface of a swimming pool, said robot comprising: a main housing; main wheels being configured for propelling the robot; an auxiliary brush-wheel disposed between said main wheels and configured for being rotated by the robot about an axis of rotation; and at least one inlet being formed in a bottom panel of the housing between said main wheels and being configured for intake of water and debris, wherein said main wheels are configured for being rotated by the robot at a first angular velocity, and said auxiliary brushwheel is configured for being rotated by the robot at a second angular velocity which is greater than the first angular velocity.

24 Claims, 6 Drawing Sheets

POOL CLEANING ROBOT

RELATED APPLICATION

This application is a continuation of U.S. patent application Ser. No. 13/684,540 filing date Nov. 25, 2012 which in turn is a continuation of U.S. patent application Ser. No. 12/793,201 filing date Jun. 3, 2010 now U.S. Pat. No. 8,424,142 which claims priority from provisional patent Ser. No. 61/184,115 filing date Jun. 4, 2009, all being incorporated herein by reference

FIELD OF THE INVENTION

This invention relates to pool cleaning robots, and to filter units for use therewith.

BACKGROUND OF THE INVENTION

Pool cleaning robots which automatically scan the floor and/or sidewalls of a swimming pool are well known in the art. These units are powered internally, by one or more battery packs, or externally, by way of a power cable. A robot of this type typically comprises a drive motor, a pump motor with an impeller, a filter, brushwheels, and a track. All of these components are contained within a housing. The housing comprises inlets at the bottom, and an outlet at the top. The robot comprises several sections, which permits at least partial disassembly of the robot.

The drive motor drives the track, which propels the robot. In addition, the motion of the track imparts a rotation to the brushwheels, which scrubs the surface of the pool.

The pump motor drives the impeller to create an upwardly directed suction. This suction draws water, and with it debris, through the inlets and exiting the outlet via the filter.

The drawing of the water through the inlets further provides a suction force which helps maintain the robot's position on the floor of the swimming pool, and is especially important for maintaining the robot on the sidewalls when scanning there.

SUMMARY OF THE INVENTION

According to one aspect of the present invention, there is provided a pool cleaning robot for cleaning a surface of a swimming pool, the robot comprising: a main housing; a pair of main wheels disposed at opposite ends of a bottom panel of the housing spanning along a majority of its width and carrying a pair of continuous tracks spanning between edges thereof, the main wheels being configured for rotating at a first angular velocity (it will be appreciated that herein, unless otherwise noted, when comparing angular velocities, only the magnitudes thereof are taken into account, with direction being ignored); at least one inlet being formed in the bottom panel between the main wheels and being configured for intake of water and debris; and at least one auxiliary brushwheel disposed between the main wheels; the robot being configured for rotating the auxiliary brushwheel about an axis of rotation at a second angular velocity which is substantially greater than the first angular velocity.

Herein the specification and claims, the term "surface" when used in reference to a pool is used in its broadest sense, including, but not limited to, bottom and side surfaces thereof.

The robot may be designed such that motion thereof is independent of the rotation of the auxiliary brushwheel, i.e., the rotation of the auxiliary brushwheel at an elevated speed does not impact the movement of the robot. For example, the auxiliary brushwheel may be disposed at a position sufficiently raised from a planar surface disposed below the robot such that motion of the robot on the planar surface is independent of the rotation of the auxiliary brushwheel. This arrangement ensures that the pressure between the auxiliary brushwheel and the planar surface is sufficiently low that it does not influence the motion of the robot.

The second angular velocity may be at least substantially twice that of the first angular velocity.

According to another aspect of the present invention, the pool cleaning robot may include a filter unit that may include a frame configured for attachment thereto of one or more filter elements and insertion into a pool cleaning robot in a fluid path between an inlet and outlet thereof for; and two or more of the filter elements of substantially different designs.

One of the filter elements may be a fine filter constituting a fabric-like screen configured to substantially cover at least one side, or two opposing sides, of the frame.

The unit may further comprise a securing element configured to substantially cover at least one side of the frame and to secure the screen therebetween. The securing element may comprises one, two, or more panes comprising a coarse filter formed integrally therewith, the securing element being configured so that the pane lies substantially in registration with the side of the frame during the securing.

The securing element may comprise one or more frame-facing walls disposed, at least when the securing element is mounted to the frame, to restrict (i.e., by obstructing) lateral movement of the screen.

The filter unit may further comprise at least one cartridge detachably attachable to a side of the frame, the cartridge comprising a fine filter.

The frame may comprise an inlet configured for being located above the inlet of the robot and a one-way valve located at the inlet. The frame may comprise a ridge around the inlet, the one-way valve comprising a flaccid tube fastened at a proximal end thereof to the ridge and a pair of elongated members extending at least across a distal end thereof, each of the elongated members being configured to be buoyed by the movement of water along the fluid path due to operation of the robot, and to sink in the absence of such movement.

According to a further aspect of the present invention, there is provided a filter element for use with the filter unit as described above.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF EMBODIMENTS

Figure 1:
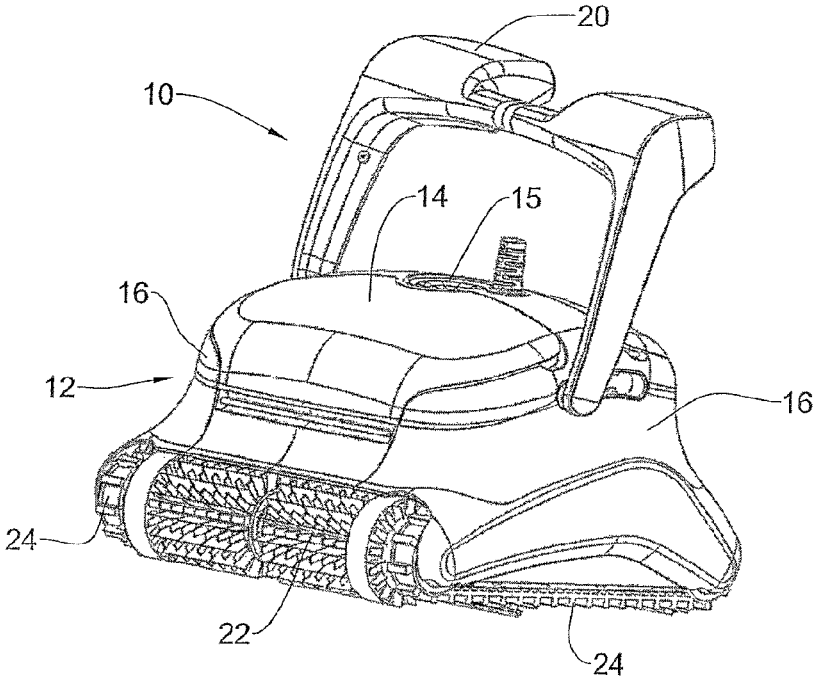
FIG. 1 is a perspective view of a robot according to the present invention.
Figure 2:
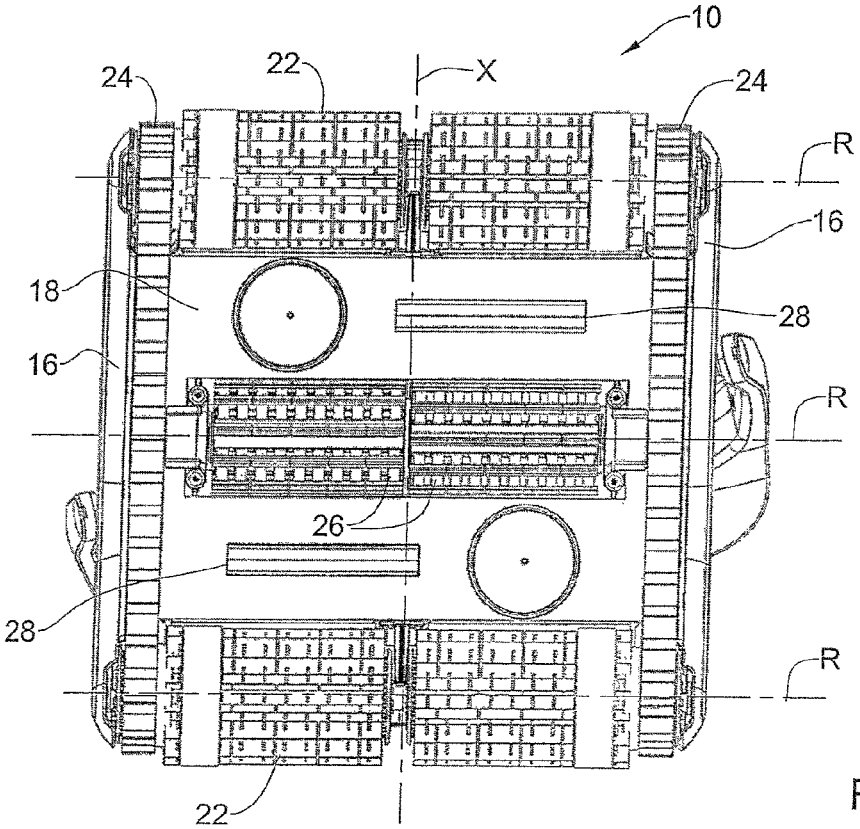
FIG. 2 is a bottom view of the robot illustrated in FIG. 1.

As illustrated in FIGS. 1 and 2, there is provided a pool cleaning robot, which is generally indicated at 10. The exterior of the robot 10 comprises a housing 12 (which comprises a removable cover 14 with an outlet 15 formed is therein, side panels 16 and a bottom panel 18) and a handle 20 attached thereto. The robot further comprises two main brushwheels 22, with a pair of continuous tracks 24 spanning therebetween, and one or more auxiliary brushwheels 26 attached adjacent the bottom panel 18. Each brushwheel is configured to rotate about a longitudinal axis of rotation R. The interior of the robot 10 comprises one or more motor units for propelling the robot, a filter unit for trapping debris entering the robot, an impeller for generating a suction for drawing water and debris through the robot and which may be driven by one of the motor units (all not shown in FIGS. 1 and 2), and other elements necessary for operation thereof. In the event that the robot 10 comprises two motor units, they may be arranged back-to-back, so that their respective shafts rotate in opposite senses.

The bottom panel 18 is bisected by an axis X spanning therealong between the midpoints of the two main brushwheels 22. A pair of inlets 28 are formed therein, one between the auxiliary brushwheel 26 and each of the main brushwheels 22, and each one being formed substantially in a different half of the bisected bottom panel 18 from the other inlet. The inlets 28 are arranged such that water and debris entering each one passes through one of the filter units before exiting through the outlet 15.

Figure 3:
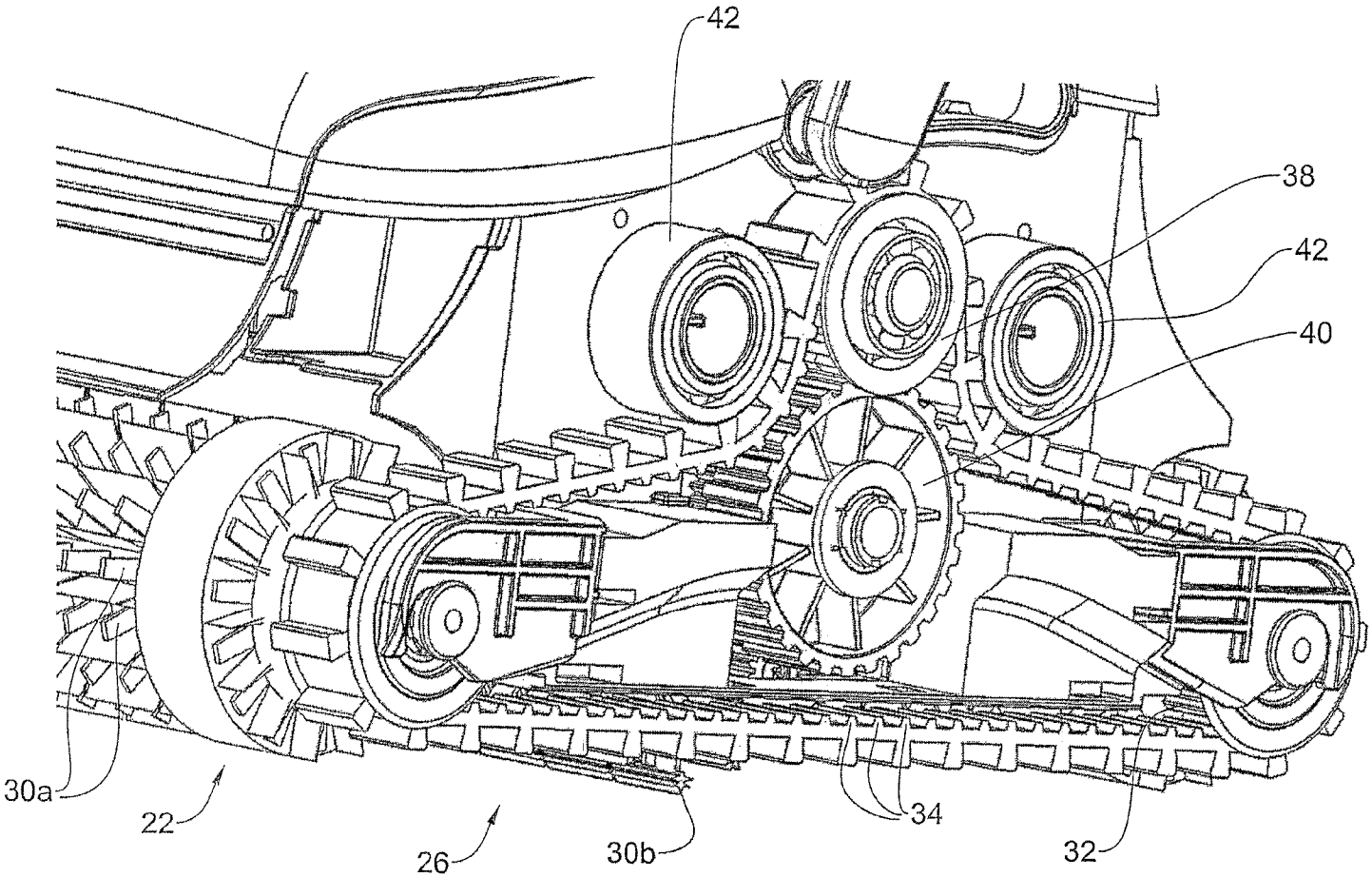
FIG. 3 is a closeup perspective view of the robot illustrated in FIG. 1, with a side panel thereof removed.

As illustrated in FIG. 3, each of the brushwheels 22, 26 is formed with a plurality of bristles 30*a*, 30*b* configured for dislodging debris from surfaces of the pool while the brushwheels are spinning during use of the robot. The bristles 30*b* of the auxiliary brushwheel 26 may be different than the bristles 30*a* of the main brushwheels 22, as will be described below.

Each of the main brushwheels 22 comprises a wheel gear 32 at least one of its ends, which is configured to rotate in tandem with its respective brushwheel. This may be accomplished by any appropriate means. For example, the wheel gear 32 may be formed integrally with the rest of the main brushwheel 22, or mounted thereto with such an arrangement which allows rotation in tandem therewith, such as with a non-circular pin (not illustrated) protruding from the main brushwheel, with the wheel gear being formed with a corresponding cavity to receive the pin. The tracks 24 are each formed with a plurality of teeth 34 configured to mesh with the wheel gear 32.

Figure 4:
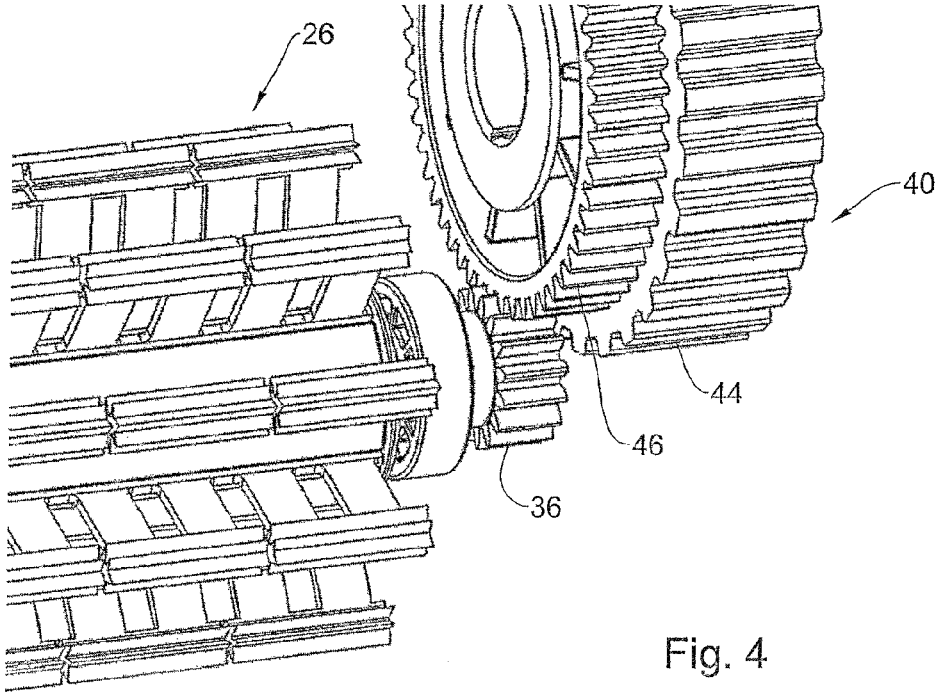
FIG. 4 is a closeup view of part of a transmission system interfacing with an auxiliary brushwheel, both of the robot illustrated in FIG. 1.

As illustrated in FIG. 4, the auxiliary brushwheel 26 comprises an auxiliary gear 36 at least one of its ends, which is configured to rotate in tandem with the auxiliary brushwheel. This may be accomplished by any appropriate means, for example those listed above in connection with the wheel gears 32.

The wheel gears 32, auxiliary gear 36, and tracks 24 constitute part of a main transmission system, which is illustrated in FIGS. 3 and 4. Besides the elements listed above, the main transmission system comprises a drive gear 38, a two-stage compound gear 40, and two tensioning rollers 42.

The drive gear 38 is configured to rotate in tandem with the shaft of the motor unit, for example by being mounted directly thereon. It thus serves as the source of rotational motion in the main transmission system. The drive gear 38 is configured to mesh with the teeth 34 of the track 24. The tensioning rollers 42 are configured to keep the track 24 in place meshed with the drive gear 38 and wheel gears 32.

The compound gear 40 comprises a first stage 44 and smaller second stage 46. It is disposed so that the first stage 44 meshes with the drive gear 38, and the second stage 46 meshes with the auxiliary gear 36. The drive gear 38, wheel gears 32, auxiliary gear 36, and stages 44, 46 of the compound gear 40 are designed such that the angular velocity of the auxiliary brushwheel 26 greatly exceeds, for example by approximately a factor of two, the angular velocity of the main brushwheels.

It will be appreciated that the robot 10 is described herein and illustrated in the accompanying drawings as comprising a transmission system only on one side, it will be appreciated that, depending on the configuration of the robot, the other side may comprise a complementary transmission system.

For example, if the robot 10 is designed such that it comprises two independently rotating auxiliary brushwheels 26, one each spanning substantially between the axis X and one of the tracks 24, the complementary transmission system may be the same as the main transmission system. This arrangement ensures that when both tracks 24 are moving in the same direction, the two auxiliary brushwheels 26 rotate in the same sense. Thus, when the robot is moving in a straight line along a surface of the pool, both auxiliary brushwheels 26 are rotating in the same sense.

According to another example, one of the transmission systems may be altered, for example by the inclusion of an additional gear (not illustrated), to ensure that when both tracks 24 are moving in the same direction, the two auxiliary brushwheels 26 rotate in opposite senses from one another. Thus, when the robot is moving in a straight line along a surface of the pool, the auxiliary brushwheels 26 are rotating in opposite senses. This may be advantageous, for example since it allows the robot 10 to utilize, at the same time, both inlets 28 on either side of the auxiliary brushwheel 26, resulting in a more even distribution of debris between the two filter units.

According to a further example, if the robot 10 is designed such that it comprises a single auxiliary brushwheel 26, then it may be designed such that it does not comprise a complementary transmission system, and it may also only comprise a single motor unit. However, the robot 10 may be provided with two motor units and a complementary transmission system, in order to provide additional power and even distribution thereof between the two tracks 24.

According to any of the above examples, or any other example, the auxiliary brushwheel 26 rotates at a higher angular velocity that the main brushwheels 22. As the brushwheels 22, 26 are substantially of the same diameter, there is relative motion between the periphery of the auxiliary brushwheel and the surface of the pool. Thus, the auxiliary brushwheel 26 scrubs the pool surface at a much greater relative speed than do the main brushwheels 22, which results in more debris being dislodged than would be in the absence of the auxiliary brushwheel, or if the auxiliary brushwheel rotated at an angular velocity similar to that of the main brushwheels.

Figure 5:
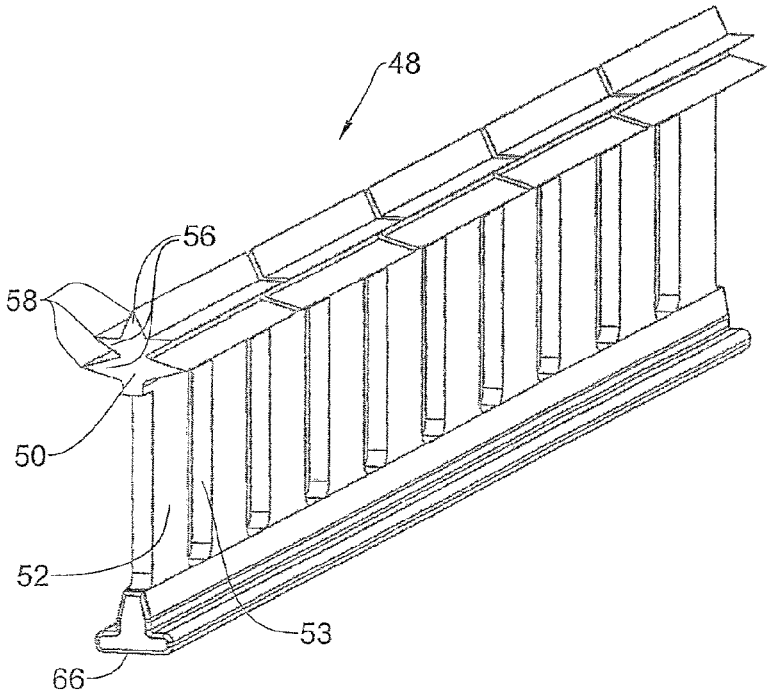
FIG. 5 is a perspective view of a bristle unit for use with the robot illustrated in FIG. 1.

As illustrated in FIG. 5, bristle units 48 may be provided on the brushwheels, and in particular on the auxiliary brushwheel 26. Each bristle unit 48 comprises a plurality of bristles 30. Each bristle 30 may comprise a head 50 disposed for engagement, during use of the robot, with the surface to be cleaned of the pool, and a shaft 52, which connects the head to its respective brushwheel or to a base strip 66 of the bristle unit 48. Each head 50 may be connected to the base strip 66

(or the brushwheel) by two shafts 52 separated from one another by a gap 53 extending between the head and the base strip (or brushwheel).

The head 50 is specifically designed to facilitate in dislodging debris from the surface of the pool. As such, it may comprise several blades 54 projecting therefrom. Each blade 56 has a distal end 58 which extends substantially parallel to the axis of rotation R of its respective brushwheel. Thus, when the brushwheel rotates about the axis R, the edge 58 of each blade 56 moves along the surface of the pool and is disposed in a direction substantially perpendicular thereto.

The shaft 52 is designed to be rigid enough to support the head 50 and provide enough pressure between it and the surface for the blades 56 to effectively dislodge debris therefrom. At the same time, it must also be flexible enough that the bristles 30 do not affect movement of the robot, i.e., they do not substantially or perceptibly bias the robot away from the surface of the pool, especially during use thereof.

Figure 6:
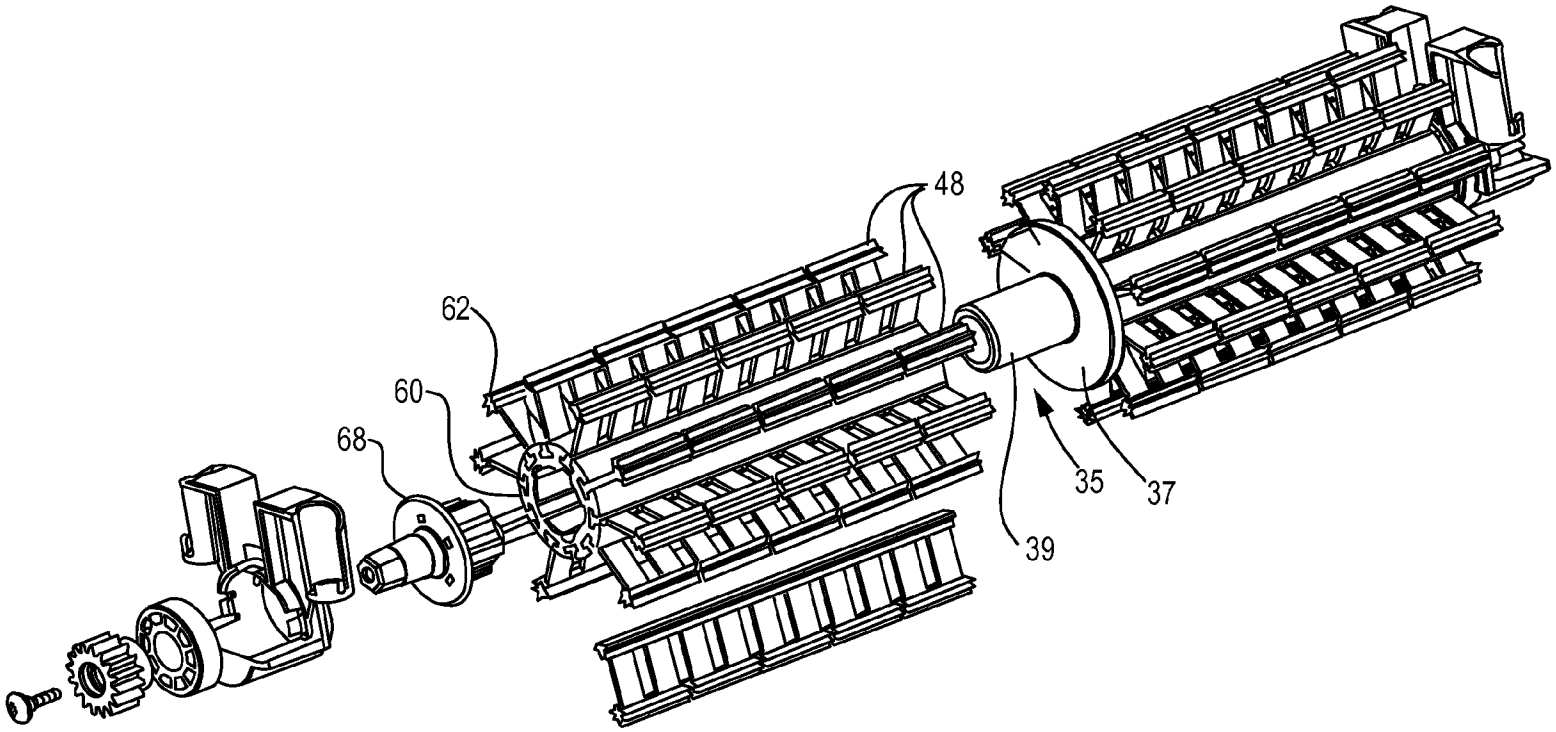
FIG. 6 is a partially exploded view of auxiliary brushwheels of the robot illustrated in FIG. 1.

As illustrated in FIG. 6, the brushwheels, and in particular the auxiliary brushwheel 26, may comprise a drive cylinder 60 which is directly rotated by the transmission system. The drive cylinder is formed on its perimeter surface with longitudinally extending grooves 62. A plurality of bristle units 48 is provided. The base strip 66 of each bristle unit 48 is formed to be slid into one of the grooves 62. The grooves 62 and base strips 66 are co-configured such that the bristle units 48 are retained within the grooves, but may be removed by a user by being slid out therefrom. An end cap 68 may be provided to prevent the bristle units 48 from sliding out of the grooves 62 during use of the robot 10, or during any other undesired time. Such an arrangement allows a user to, e.g., replace worn-out or damaged bristles, or to replace the bristle units 48 with improved bristle units that may be developed.

As further seen in FIG. 6, in the event that the robot 10 comprises two independently rotating brushwheels 26, a spindle 35 may be provided spanning between the two. The spindle 35 comprises a base 37 with two circular projections 39 (only one seen in FIG. 6) projecting symmetrically from opposite sides thereof. Each projection 39 is rotatably received within an end of the drive cylinder 60. This arrangement contributes to the stability of the brushwheels 26 within the robot 10.

Figure 7A:
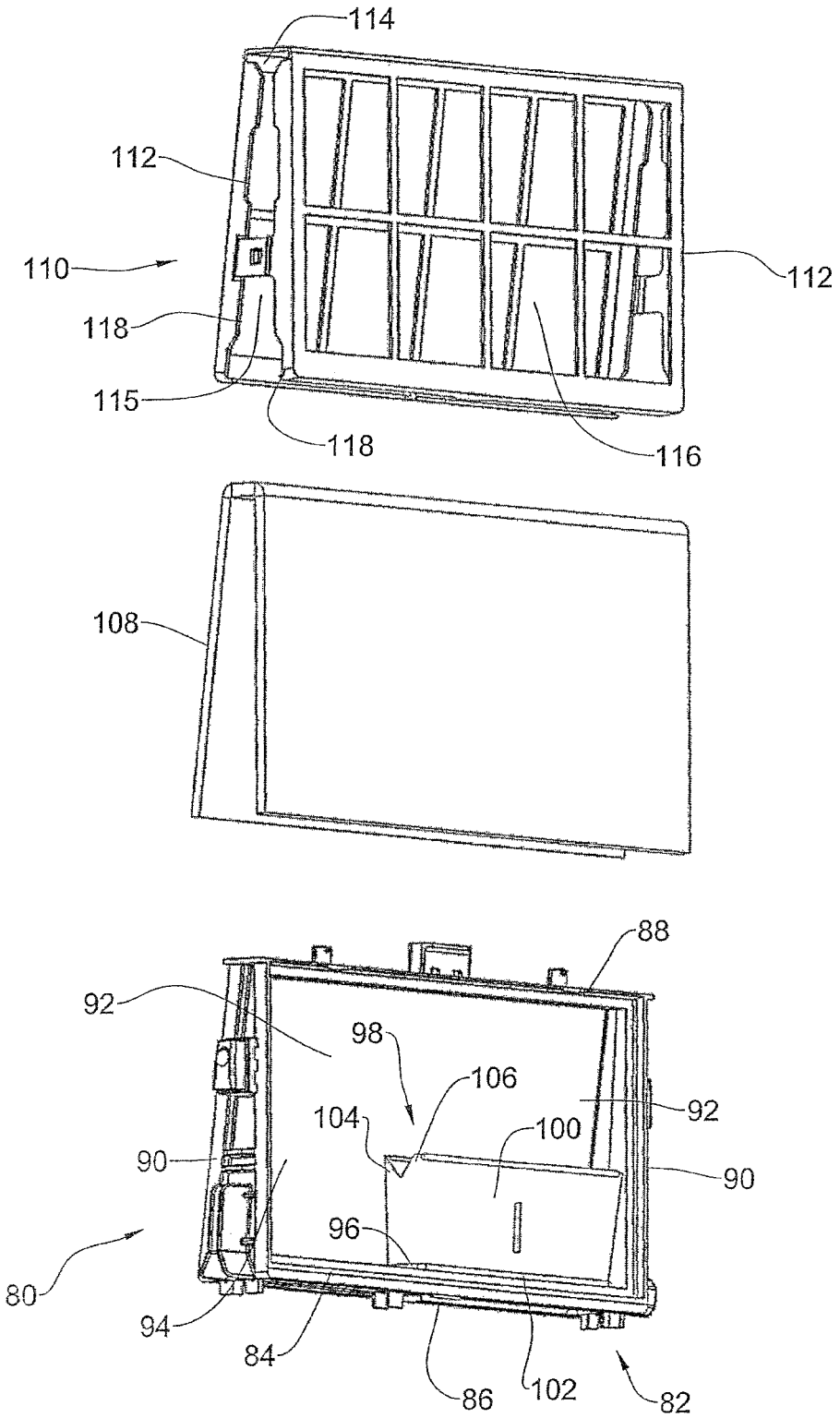
FIGS. 7A and 7B are exploded views of a filter unit for use with a pool cleaning robot.

The robot 10 may comprise one or more filter units 80, illustrated in FIG. 7A, which allows a user to selectively choose the degree of cleaning which is performed by the robot. Typically, the robot 10 comprises one filter unit 80 corresponding to each inlet 28 thereof, although the specific construction of the robot may allow more or fewer filter units.

The filter unit 80 comprises a rigid frame 82 designed to be inserted via the top of the robot 10 when the cover 14 is removed, and attached to an inner side of the bottom panel 18 of the housing 12. Thus, the filter unit 80 may be easily removed for cleaning, replacement of filter elements (as described below), and other necessary servicing thereof.

The frame 82 comprises a bottom panel 84 having a filter inlet 86, a top panel 88, and two opposing closed side panels 90 and two opposing open side panels 92, each extending transversely between the bottom panel 84 and the top panel. The open side panels 92 are disposed opposite one another, and each is formed having a window 94 configured to allow water to pass therethrough. The bottom, top, and side panels 84, 88, 90, 92 define an enclosed volume (save for the filter inlets 86 and windows 94) therebetween.

Each filter inlet 86 is formed within the bottom panel 84 such that when the frame 82 is attached to the bottom panel 18 of the housing 12, it is substantially aligned with one of the inlets 28 of the robot 10. Thus, the enclosed volume of the filter unit 80 is in a fluid path between its associated inlet 28 and the outlet 15. In addition, each filter inlet 86 is formed with a ridge 96 therearound, projecting upwardly into the enclosed volume.

The frame 82 is configured for attachment thereto of one or more filter elements which are designed for use thereof. Two or more filter elements, each of a different coarseness, are provided with the frame 82. Each filter element may be selectively attached to and removed from the frame, depending on the intended use of the filter unit 80. For example, a coarse filter element (i.e., designed to remove large debris, even though smaller debris may pass therethrough) and a fine filter element (i.e., designed to remove small debris) may be provided, for use, respectively, to remove large debris (e.g., at the beginning of a season when there are many large pieces of debris in the pool) and for regularly scheduled cleaning throughout the season.

A one-way valve, which is generally indicated at 98, may be provided at the filter inlet 86, attached to the ridge 96 thereof. The valve 98 may comprise a flaccid tube 100, which is fastened at a proximal end 102 thereof to the ridge 96, such that all debris entering the filter inlet 86 passes therethrough under influence of suction generated by the impeller. The valve 98 further comprises a pair of elongated members 104 attached to and extending along at least a distal end 106 of the tube 100. Each of the members 104 is configured to be buoyed by the movement of water along the fluid path due to the suction generated during operation of the robot 10, and to sink in the absence of such movement.

Thus, during operation of the robot 10, the distal end 106 of the tube 100 is open, allowing water and debris to freely flow therethrough. When the suction is terminated, typically due to a cessation of operation of the robot 10, the tube 100, under the influence of the sinking of the elongated members 104, collapses, preventing debris from exiting the filter unit 80 via the filter inlet 86 and be deposited on the pool surface adjacent thereto. The tube 100 may be made of a filter material, so that water can drain from the filter unit 80 via the filter inlet 86.

The fine filter element 108 may be provided as a fabric-like screen which is provided so that it covers the open side panels 92 of the frame 82. According to this arrangement, when the fine filter element 108 is mounted to the frame 82, all unfiltered water passing through the filter unit 80 will be subject to fine filtering. A securing element 110 is provided to secure the fine filter element 108 in place.

The securing element 110 comprises two panes 112, each articulated to a connecting element 114. The panes 112 are each formed with coarse filter elements 116. The panes 112 and the connecting element 114 are designed so that when the fine filter element 108 is in place, the securing element 110 is secured between it and the frame 82, with the panes 112 lying in registration with the open side panels 92 thereof. In addition, locking elements 115 are provided to hold the securing element 110 in place during use.

The securing element 110 further comprises frame-facing walls 118, which are disposed along the periphery thereof, and project toward the frame 82 when the securing element is mounted thereto. The walls 118 are arranged such that when the fine filter element 108 held therewithin, lateral (i.e., side to side) motion of the fine filter element is restricted, i.e., it will be prevented by the walls from sliding out of the securing element 110. It will be appreciated that even in the absence of the walls 118, the lateral movement of the fine filter element 108 is limited, for example by the pressure between the securing element 110 and the frame 82, etc.

When coarse filtering is desired, the fine filter element 108 is removed, and the securing element 110 is used alone. When fine filtering is desired, the fine filter element 108 is replaced. In such a case, as the fine filtering is accomplished at a location which is upstream from the coarse filter element 116, they do not perform a significant amount of filtering.

Figure 7B:
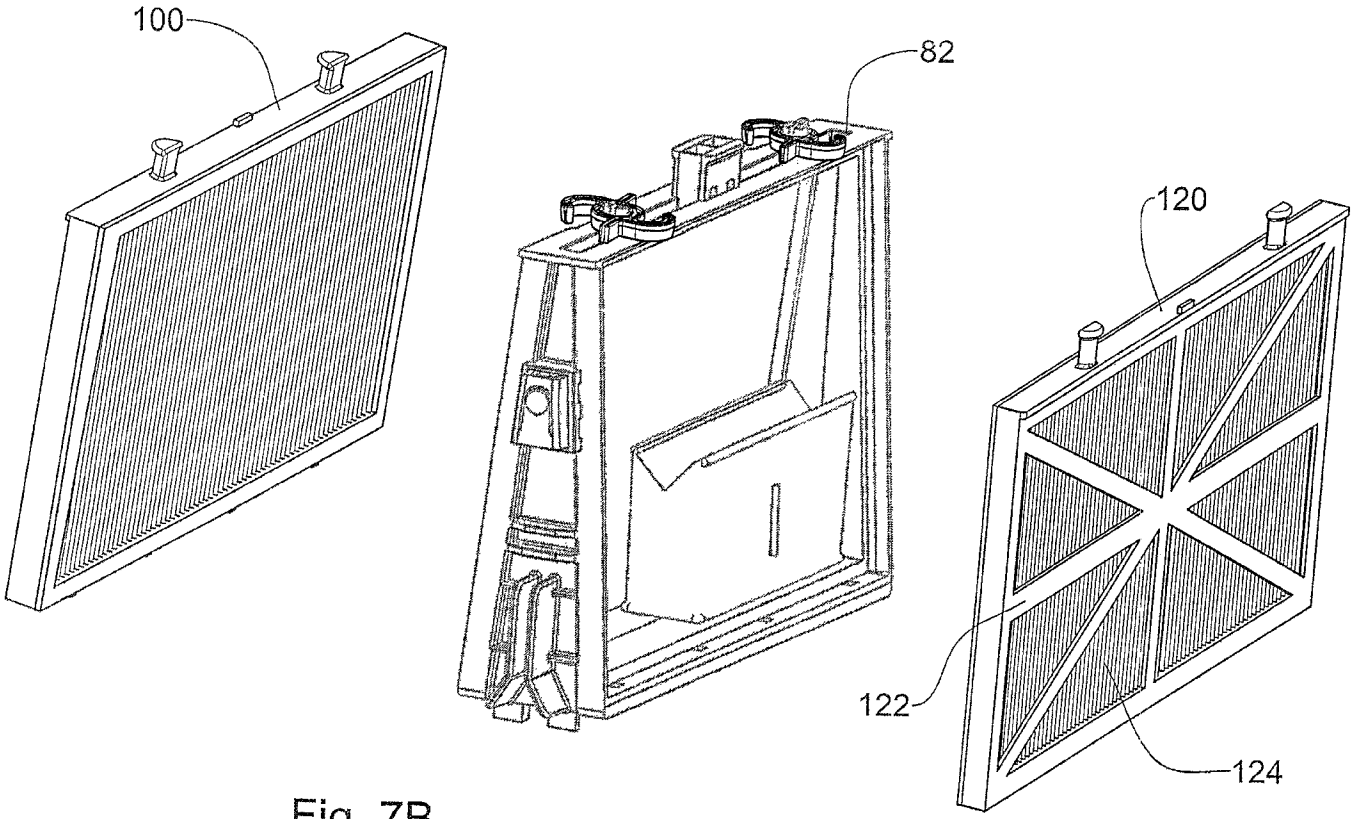

In addition, as illustrated in FIG. 7B, filter cartridges 120 may be provided. The cartridges 120 comprise a rigid casing 122 housing a fine filter element 124, and are designed so as to fit and be secured within the window 94 of one of the open side panels 92. A similar cartridge is disclosed in WO 2007/015251 in FIGS. 8C and 8D and the accompanying description, which is incorporated herein by reference.

It will be appreciated that the filter unit 80 may be provided with the robot 10, either with the filter elements attached thereto or separate therefrom, and/or it may be provided as a separate kit, and specifically configured or designed for use with one or more specific pool cleaning robots.

Those skilled in the art to which this invention pertains will readily appreciate that numerous changes, variations and modifications can be made without departing from the scope of the invention mutatis mutandis.

I claim:

1. A pool cleaning robot for cleaning a surface of a swimming pool, said robot comprising: a main housing; main wheels being configured for propelling the robot; an auxiliary brushwheel disposed between said main wheels and configured for being rotated by the robot about an axis of rotation; and at least one inlet being formed in a bottom panel of the housing between said main wheels and being configured for intake of water and debris; wherein said main wheels are configured for being rotated by the robot at a first angular velocity, a filter unit that comprises a frame; wherein the frame comprises an inlet configured for being located above the inlet of the robot and a one-way valve located at the inlet of the frame; wherein said one-way valve comprising a flaccid tube fastened at a proximal end thereof to said ridge and a pair of elongated members extending at least across a distal end thereof, each of said elongated members being configured to be buoyed by the movement of water along the fluid path due to operation of the robot, and to sink in the absence of such movement.

2. The pool cleaning robot according to claim 1, wherein said auxiliary brushwheel is driven by a transmission gear, said robot further comprising a drive gear configured to engage one of a plurality of continuous tracks carried by the main wheels and to engage said transmission gear.

3. The pool cleaning robot according to claim 1, being designed such that motion thereof is independent of the rotation of the auxiliary brushwheel.

4. The pool cleaning robot according to claim 1 comprising a drive gear configured to engage one of continuous tracks carried by the main wheels and to engage a transmission gear.

5. The pool cleaning robot according to claim 1 comprising a compound gear with first and second gear stages, the compound gear being arranged such that the first gear stage meshes with a drive element, and the second gear stage meshes with a gear rotationally fixed to the auxiliary brushwheel; wherein one of continuous tracks carried by the main wheels is configured with the drive element.

6. The pool cleaning robot according to claim 1 wherein the auxiliary brushwheel is positioned at substantially a same distance from rear and front ends of a bottom panel of said housing.

7. The pool cleaning robot according to claim 1 comprising a filter unit.

8. The pool cleaning robot according to claim 7 wherein the filter unit comprises two or more filter elements of different coarseness.

9. The pool cleaning robot according to claim 7 wherein the filter unit comprises a frame that is removably attached to an inner side of a bottom panel of the main housing.

10. The pool cleaning robot according to claim 9 comprising two or more filter elements of substantially different designs that are removably attached to the frame.

11. The pool cleaning robot according to claim 10 wherein the two or more filter elements comprise a fine filter that comprises a fabric-like screen which is provided so that it covers the at least one side of the frame.

12. The pool cleaning robot according to claim 11 wherein the fabric-like screen is provided so that it covers two opposing sides of the frame.

13. The pool cleaning robot according to claim 11 comprising a securing element configured to substantially cover at least one side of said frame and to secure said fabric-like screen therebetween.

14. The pool cleaning robot according to claim 13 wherein said securing element comprises at least one pane that comprises a coarse filter formed integrally therewith, said securing element being configured so that the pane lies substantially in registration with said side of the frame during the securing.

15. The pool cleaning robot according to claim 14 wherein said securing element comprises two of said panes.

16. The pool cleaning robot according to claim 13 wherein the securing element comprises one or more frame-facing walls disposed, at least when the securing element is mounted to said frame, to restrict lateral movement of said fabric-like screen.

17. The pool cleaning robot according to claim 13 wherein the frame comprises an inlet configured for being located above the inlet of the robot and a one-way valve located at the inlet of the frame.

18. The pool cleaning robot according to claim 9 comprising at least one cartridge detachably attachable to a side of said frame, said cartridge comprising a fine filter.

19. The pool cleaning robot according to claim 1 wherein said main wheels are configured for being rotated by the robot at a first angular velocity, and said auxiliary brushwheel is configured for being rotated by the robot at a second angular velocity which is greater than the first angular velocity.

20. The pool cleaning robot according to claim 1, further comprising an end cap that is arranged to prevent a bristle units of the auxiliary brushwheel from sliding out of grooves of the auxiliary brush wheel.

21. The pool cleaning robot according to claim 1 further comprising an end cap that is arranged to rotate a drive cylinder of the auxiliary brushwheel.

22. The pool cleaning robot according to claim 1 further comprising an end cap that is arranged to be rotated by an auxiliary gear.

23. The pool cleaning robot according to claim 1 further comprising an end cap that comprises a first portion that interfaces with an auxiliary gear and a second portion that interfaces with a drive cylinder of the auxiliary brushwheel; wherein a shape of the first portion differs from a shape of the second portion.

24. The pool cleaning robot according to claim 23 wherein the first portion has an hexagonal cross section and wherein the second portion has five protuberances.

* * * * *